US005402573A

United States Patent [19]

Laniado

[11] Patent Number: 5,402,573

[45] Date of Patent: Apr. 4, 1995

[54] TWIN BLADE SPRAY RAZOR

[75] Inventor: Shlomo Laniado, Tel-Aviv, Israel

[73] Assignee: Aurora Dawn Ltd., Tel-Aviv, Israel

[21] Appl. No.: 243,397

[22] Filed: May 16, 1994

[30] Foreign Application Priority Data

May 20, 1993 [IL] Israel ..... 105759

[51] Int. Cl.[6] ..... B26B 19/44

[52] U.S. Cl. ..... 30/41; 30/86

[58] Field of Search ..... 30/41, 41.5, 85, 86, 30/123.3, 124, 125

[56] References Cited

U.S. PATENT DOCUMENTS

| | | | |
|---|---|---|---|
| 1,852,708 | 4/1932 | Stuart | 30/41 |
| 2,037,588 | 4/1936 | Pica | 30/41 |
| 2,780,862 | 4/1954 | Grathwohl . | |
| 3,139,683 | 7/1964 | Waldman | 30/41 |
| 3,412,465 | 11/1968 | Andersen | 30/41 |
| 4,238,882 | 12/1980 | Harrison, Sr. . | |
| 4,480,387 | 11/1984 | d'Alayer de Costemore d'Arc . | |
| 4,696,106 | 8/1987 | Cross et al. | 30/41 |
| 4,941,492 | 7/1990 | Morgan | 30/41 |
| 5,121,541 | 6/1992 | Patrakis | 30/41 |
| 5,241,751 | 9/1993 | Goh | 30/41.5 |

FOREIGN PATENT DOCUMENTS

| | | | |
|---|---|---|---|
| 152005 | 7/1951 | Australia . | |
| 2542660 | 3/1983 | France . | |
| 2514174 | 10/1976 | Germany | 30/41 |
| 3142178 | 6/1982 | Germany . | |

*Primary Examiner*—Hwei Siu Payer
*Attorney, Agent, or Firm*—Browdy and Neimark

[57] ABSTRACT

A twin-blade safety razor comprising a two compartment handle or bulb, one for storing air, the other for storing a liquid. Air and liquid are simultaneously dispensed from the separate compartments so as to form a fine spray for cleaning debris from between the blades of the razor assembly or for cleaning a part of the body to be shaved.

12 Claims, 5 Drawing Sheets

TWIN BLADE SPRAY RAZOR

FIELD OF THE INVENTION

This invention relates to a twin razor blade and particularly to such a blade having integral cleansing means.

BACKGROUND OF THE INVENTION

A drawback when using twin razor safety blades is that shaving foam and hair debris accumulates between the blades thereby detracting from the cutting efficiency thereof. Even though, during use, the razor may be frequently rinsed under running water, the proximity between the blades militates against effective removal of such debris.

U.S. Pat. No. 5,241,751 (Goh) discloses a twin-blade razor assembly having an integral air cleansing facility. The twin-blade razor assembly includes a disposable twin-blade cartridge, a head assembly for retaining the twin-blade cartridge, a handle having an air reservoir and an air tube extending between the air reservoir and the head assembly. Air pumping means (of the piston type) are provided for pumping air from the reservoir to the head assembly via the air tube. As best seen in FIGS. 5 and 6 of the Goh reference, air is injected directly between the twin blades (via an opening in the lower blade) and underneath the lower blade.

U.S. Pat. No. 3,412,465 (Andersen) shows a double-edge safety razor having a handle equipped with two squeeze bulb type reservoirs each having a liquid lubricant stored therein. Each reservoir is connected to a liquid dispensing tube for dispensing lubricant on to the surface to be shaved adjacent to a side of the blade.

U.S. Pat. No. 3,139,683 (Waldman) discloses a double-edge safety razor including a squeeze bulb positioned at the butt end of the razor handle, for dispensing a liquid lubricant via a fluidic passageway to both edges of the blade.

Australian Patent No. 152,005 (Schell) discloses a double-edge safety razor having a liquid reservoir in the handle assembly, the liquid being distributed to the double-edge blade from the reservoir to clean the blade. Dispensing is carried out by squeezing a flexible bulb mounted in or on the handle.

U.S. Pat. No. 4,696,106 (Cross et al.) discloses a single use disposable medical razor having an elongated handle within which is disposed a hollow portion for containing a shaving cream comprising a mixture of various fungicides, viricides and bactericides and the like. A plunger slidably disposed within the handle tends to force the shaving cream out through a dispensing orifice in the distal end of the handle.

Whilst all of the above-referenced patents disclose razor blades having some form of integral cleaning mechanism, all are based on the expulsion of either a liquid lubricant (such as water) or air for the purpose of cleaning debris from between the blades of a twin-blade razor assembly.

U.S. Pat. No. 5,121,541 (Patrakis) discloses an electric razor housing a misting mechanism for misting a lubricating agent, such as water, cologne or beard softener on to the user's skin while shaving. The misting mechanism comprises a mist conduit, a misting container and an ultrasonic vibrator. A protective screen overlies the mist conduit to prevent whiskers from contaminating the misting mechanism.

It is to be noted that the resulting mist produced by the Patrakis patent is intended to spray cologne or pre-shave solution on to the face during the act of shaving and, to this end, it will readily be appreciated that the mist may be applied at low pressure. As such, the mist is certainly not adapted to clean debris from the shaver since, in order to do this in the manner disclosed by the above-mentioned references, a jet of air or water must be directed at high pressure towards the shaving head. Furthermore, the built-in mister disclosed by Patrakis is electrically operated and, whilst being suitable for electric razors, is hardly adaptable for safety razors having one or more blades.

It would clearly be preferable to provide a safety razor having an integral cleaning means permitting a fine spray to be emitted manually.

SUMMARY OF THE INVENTION

It is an object of the invention to provide such a twin-blade razor assembly wherein the drawbacks associated with hitherto proposed devices are significantly reduced or eliminated.

According to the invention there is provided a safety razor comprising:

- a head assembly having fixed thereto a safety razor cartridge having at least one blade in a predetermined spaced relationship to the head assembly,
- a handle attached to the head assembly, said handle comprising
- an air tube having a first end anchored in the head assembly so as to lie proximate the at least one blade in said cartridge when the cartridge is fixed to the head assembly,
- air pumping means connected to a second end of the air tube for pumping air therethrough,
- a liquid pumping means for storing a quantity of liquid, and
- a liquid tube having a first end anchored in the head assembly proximate the air tube and having a second end coupled to the liquid pumping means;
- whereby operating the air pumping means and the liquid pumping means simultaneously emits the air and the liquid as a spray proximate the at least one blade when the cartridge is fixed to the head assembly.

Preferably the razor is of the twin-blade type and a liquid tube having one or more branches is also provided, the air tube likewise being branched so that, by a single pumping action, air and a suitable liquid may be simultaneously injected into the razor cartridge between the twin razor blades, thereby resulting in a fine spray of liquid which cleans the debris from the razor cartridge. Typically, the liquid may be water, an antiseptic, an alcohol-based solvent and the like.

Preferably, the liquid and air are pumped by means of a flexible bulb having separate compartments for storing therein the air and the liquid, respectively. By squeezing the flexible bulb, the liquid is emitted as a spray from the first end of the liquid tubes as required.

BRIEF DESCRIPTION OF THE DRAWINGS

In order to understand the invention and to see how the same may be carried out in practice, a preferred example will now be described, by way of non-limiting example only, with respect to the accompanying drawings, in which.

DETAILED DESCRIPTION OF A PREFERRED EMBODIMENT

Figure 1:
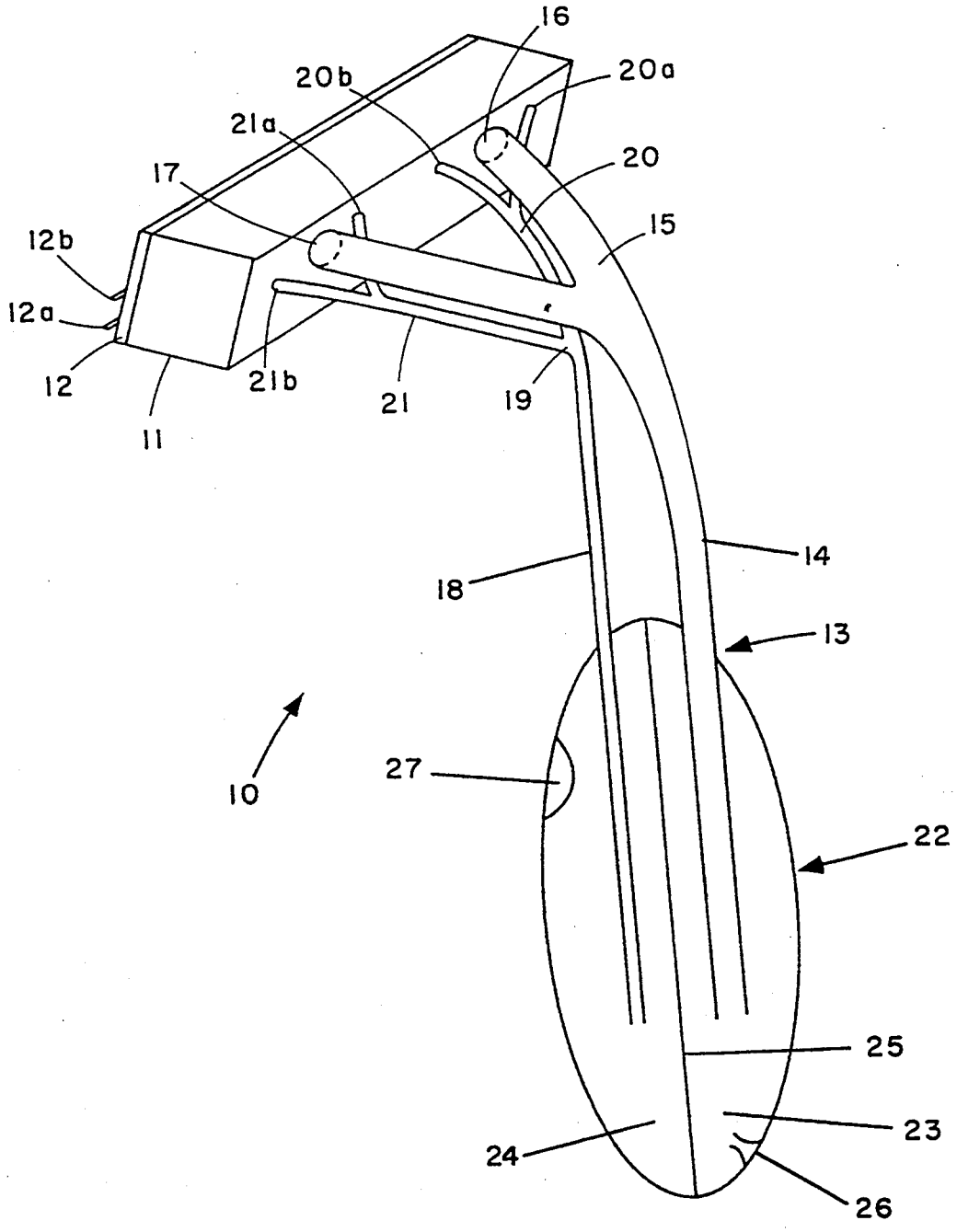
FIG. 1 is a pictorial diagram showing a perspective view of a twin-blade razor having an integral liquid-air reservoir according to a first embodiment of the invention.
Figure 2:
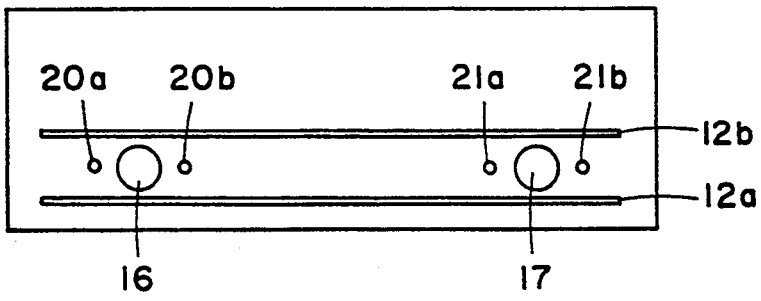
FIG. 2 shows a front elevation of a head assembly in the twin-blade razor according to the invention.

FIGS. 1 and 2 show a twin-blade razor depicted generally as 10 comprising a head assembly 11 to which may be removably coupled a twin-blade razor assembly 12 comprising twin blades 12*a* and 12*b*.

A handle, shown generally as 13, is fixed to the head assembly and includes an air tube 14 terminating at a first end 15 thereof in a pair of branches 16 and 17 which are respectively anchored in the head assembly 11 so as to lie between the twin blades in the cartridge 12 when the cartridge 12 is fixed to the head assembly 11.

Likewise, the handle 13 includes a water tube 18 (constituting a liquid tube) which terminates at a first end 19 thereof in a pair of branches 20 and 21 each of which itself is split into a pair of branches 20*a*, 20*b*, and 21*a*, 21*b*, respectively which are anchored in the head assembly 11 on opposite sides of the respective branches 16 and 17 of the air tube 14.

Respective second ends of the air tube 14 and the water tube 18 are connected to a flexible bulb 22 which constitutes an integral pumping means whereby air and water may simultaneously be pumped through the respective tubes 14 and 18.

The flexible bulb 22 comprises two separate compartments 23 and 24 separated by a common wall 25, each of the compartments 23 and 24 serving to store therein air and water, respectively. A one-way valve 26 is fitted into a periphery of the air compartment 23 for admitting air therein, whilst preventing air from escaping out of the air compartment 23 other than through the air tube 14. An entry orifice 27 is provided in a periphery of the water compartment, whereby the water compartment 24 may be filled with water prior to use of the razor.

In use, the water compartment 24 is filled with water, the twin-blade razor cartridge 12 is fitted on to the head assembly 11, whereupon shaving commences in the normal manner. Whenever it is desired to clean the razor cartridge 12, all that need be done is for the user to squeeze the flexible bulb 22, whereupon air is forced through the air tube 14 out of the branches 16 and 17 whilst, at the same time, water is forced through the water tube 18 out of the branches 20*a*, 20*b*, 21*a* and 21*b*, the resulting water jets interacting with the proximate air jets so as to produce a fine water spray between the twin blades in the razor cartridge 12. It has been found, in practice, that the resulting spray of water cleans any accumulated debris from between the blades 12*a* and 12*b* far more effectively than a single jet, or even multiple jets, of water.

The effectiveness of the spray when directed between the blades 12*a* and 12*b* depends on the pressure and also on the quantity of spray which is ejected consequent to depressing the flexible bulb 22. This, in turn, depends on the volume of the separate compartments 23 and 24 and it is therefore to be noted that FIG. 1 is a pictorial representation only which is not drawn to scale.

Figure 3A:
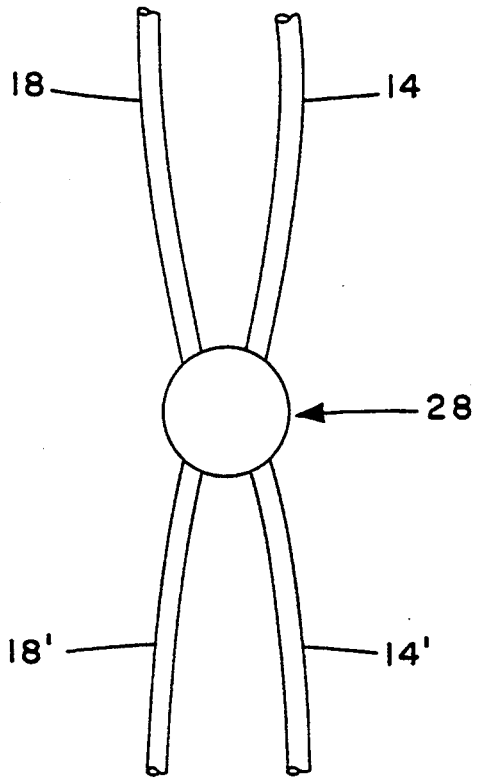
FIGS. 3*a*, 3*b* and 3*c* show schematically a mixer valve for adjusting the relative proportion between air and liquid in the twin-blade razor according to the invention.
Figure 3B:
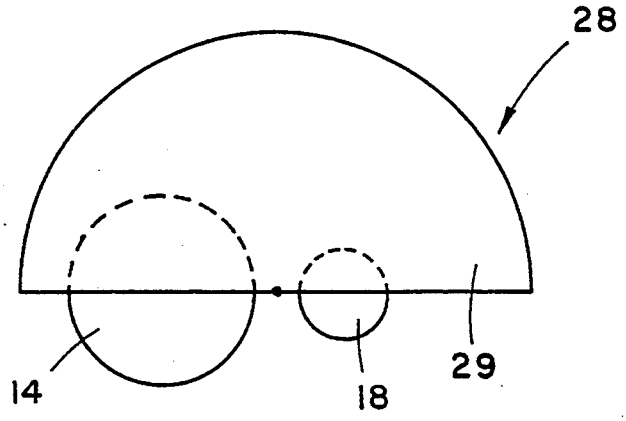
Figure 3C:
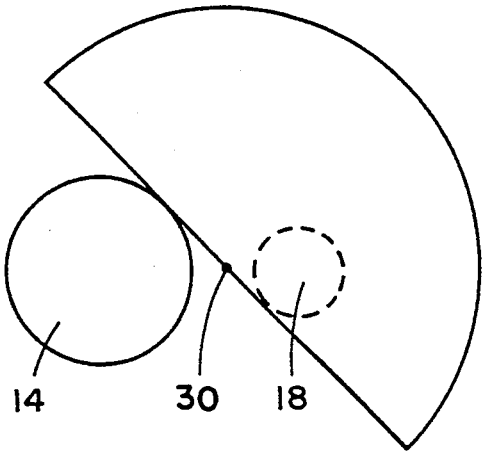

FIGS. 3*a*, 3*b* and 3*c* show schematically an optional mixer valve 28 which interconnects the air tube 14 and the water tube 18 coupled to the head assembly 11 (shown in FIG. 1) to corresponding ends 14' and 18' of the air tube and water tube, respectively, coupled to the flexible bulb 22. The mixer valve 28 which comprises a closure means 29 rotatable about an axis 30 so that, in the position shown in FIG. 3*b*, it partially covers the air tube 16 as well as the water tube 18 whereas in the position shown in FIG. 3*c* it completely covers the water tube 18 whilst fully opening the air tube 16. Thus, the mixer valve 22 constitutes an adjustment means such that by rotating the closure means 29, the air-to-water ratio of the resulting water spray may be adjusted in order to improve the cleansing efficiency according to the type and quantity of debris accumulated between the blades 12*a* and 12*b* in the razor cartridge 12.

It will be noted that the water compartment 24 is integral with the razor 10 and thereby obviates any need to connect the razor 10 to a source of water. Consequently, although the preferred embodiment has been described with particular reference to the use of water, it will be readily appreciated that other liquids can equally well be employed. For example, the razor assembly according to the invention is particularly suitable for use in hospitals wherein disposable, single-use twin-blade cartridges are used for removing body hair prior to performing surgery. For such a use, antiseptic liquid or alcohol based solvent may be employed instead of water.

Figure 4:
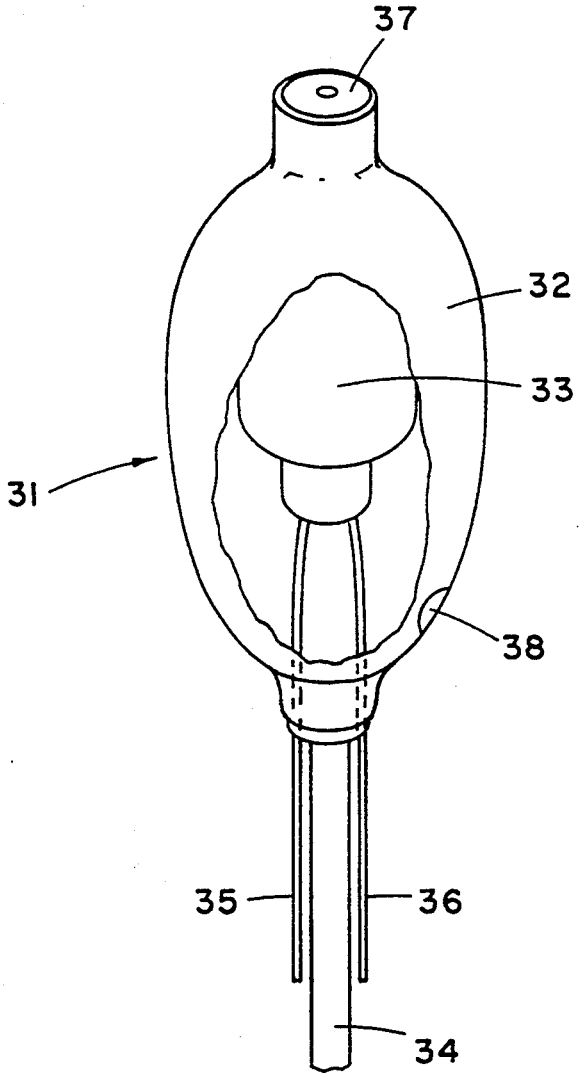
FIGS. 4 and 5 are pictorial diagrams showing perspective views of alternative liquid-air reservoirs for use with the razor illustrated in FIG. 1.

FIG. 4 shows an alternative embodiment of a flexible bulb 31 comprising two separate compartments 32 and 33, constituting first and second compartments, respectively. The first compartment 32 contains air and is connected to an air tube 34 which, in turn, is coupled to the head assembly (not shown) as explained above with reference to FIG. 1 of the drawings. Likewise, the second compartment 33 contains liquid and is coupled to the head assembly via two branch tubes 35 and 36. The second compartment 33 constitutes a reservoir for containing liquid and is filled via a removable end cap 37 with a liquid such as water, alcohol or antiseptic solution. A one-way valve 38 is fitted into a periphery of the first compartment 32 for admitting air therein, whilst preventing air from escaping out of the first compartment 32 other than through the air tube 34.

In use, pressure is applied to the air compartment 32 causing air to be emitted through the air tube 34 whilst, at the same time, applying pressure to the liquid compartment 33 so as to eject liquid through the liquid tubes 35 and 36. The simultaneous ejection of air and liquid ejects a fine spray at high pressure between the twin blades of the razor assembly.

Figure 5:
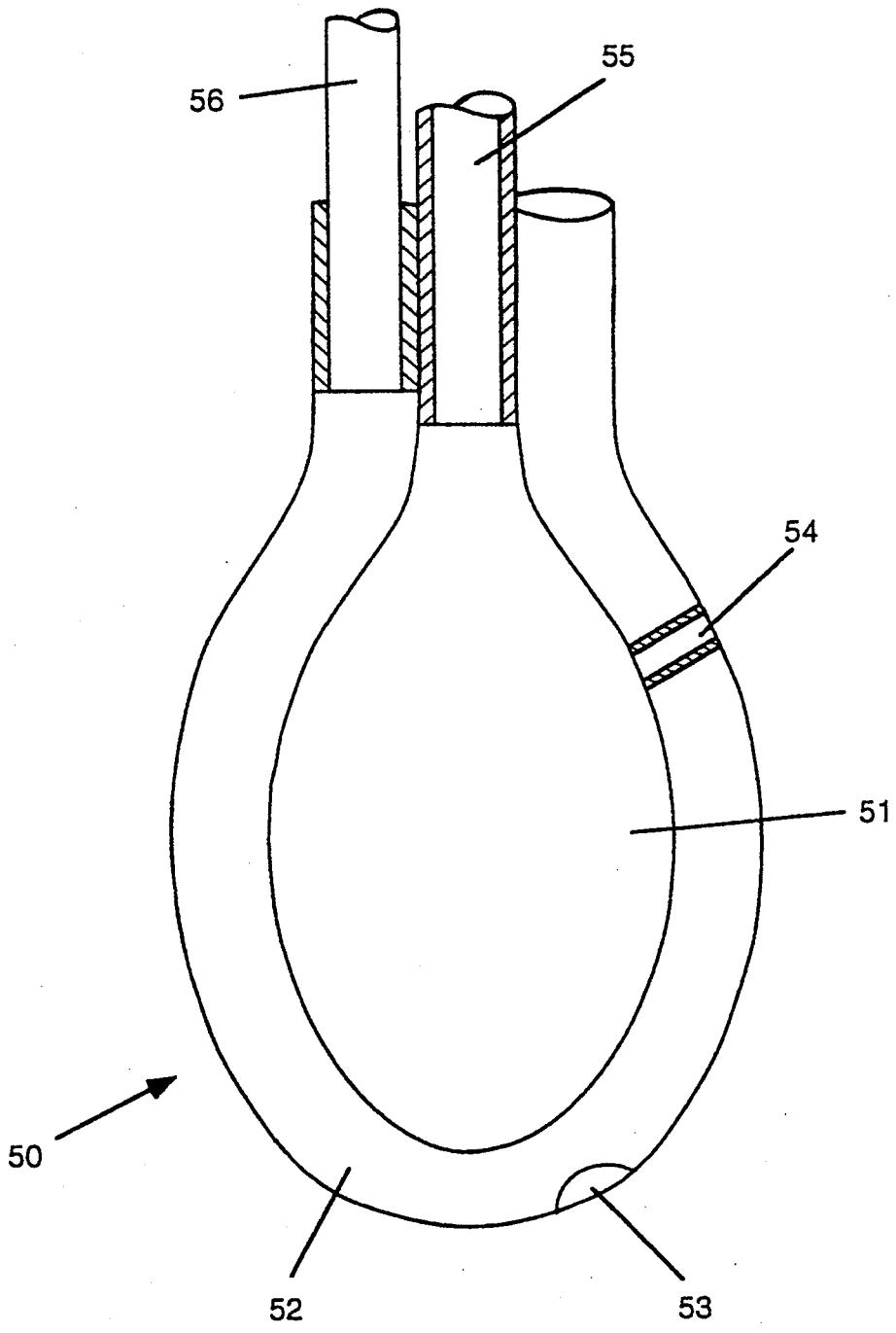

FIG. 5 shows a further embodiment of a flexible tube 50 comprising two separate bulbs 51 and 52 for containing therein air and liquid, respectively. The liquid compartment 52 is filled with a suitable liquid via a removable end cap 53. A one-way air valve 54 extends through the liquid compartment 52 so as to allow air to enter the air compartment 51 whilst preventing air from escaping therefrom other than through an air tube 55 provided at a mouth of the air compartment 51 and connected at its other end to a head assembly (not shown). Likewise, liquid tubes 56 (one only being shown) are provided for connecting the liquid compartment 52 to the head assembly.

Conceptually, the flexible tube 50 shown in FIG. 5 is similar to that described above with reference to FIG. 4 except that in FIG. 4 the liquid compartment is innermost whilst in FIG. 5 the liquid compartment is outermost. Operation of the two devices is similar.

Thus, there is provided a safety razor having an integral pumping means permitting a fine spray to be emitted manually at sufficiently high pressure to clean debris from the razor cartridge. Alternatively, antiseptic solution and the like may be dispensed in a medical razor.

Whilst in the preferred embodiment, a mixer valve is employed so as to adjust the relative the air-to-liquid ratio ejected by the integral pumping means, it will be understood that the same effect can be achieved by altering the pressure of only one of the air and water tubes. Thus, a simple tap can be employed in the air tube, for example, in order to adjust the air pressure whilst maintaining the liquid pressure constant, so as to adjust the relative liquid-to-air ratio.

It will be appreciated that other modifications may be made to the structure of the device without departing from the spirit of the invention.

I claim:

1. A safety razor comprising:

a head assembly having fixed thereto a safety razor cartridge having at least one blade in a predetermined spaced relationship to the head assembly, a handle attached to the head assembly, said handle comprising an air tube having a first end anchored in the head assembly so as to lie proximate the at least one blade in said cartridge when the cartridge is fixed to the head assembly, air pumping means connected to a second end of the air tube for pumping air therethrough, a liquid pumping means for storing a quantity of liquid, and a liquid tube having a first end anchored in the head assembly proximate the air tube and having a second end coupled to the liquid pumping means, whereby operating the air pumping means and the liquid pumping means simultaneously emits the air and the liquid as a spray proximate the at least one blade when the cartridge is fixed to the head assembly.

2. The razor according to claim 1, wherein the safety razor cartridge contains two spaced-apart blades and the first end of both the air tube and liquid tube are anchored between said blades.

3. The razor according to claim 2, wherein the air pumping means and the liquid pumping means are integral.

4. The razor according to claim 3, further including an adjustment means connected to at least one of the air tube and the liquid tube for adjusting an air-to-liquid ratio ejected by the integral pumping means.

5. The razor according to claim 4, wherein the adjustment means is a mixer valve interconnected between the air tube and the liquid tube.

6. The razor according to claim 3, wherein the air pumping means and the liquid pumping means comprise:

a flexible hollow bulb having separate first and second compartments, the first compartment for containing air and the second compartment sewing as a reservoir for storing the liquid therein, a one-way valve in the first compartment for admitting air therethrough into the first compartment, and an entry orifice in the second compartment for pouring the liquid therethrough when filling the reservoir.

7. The razor according to claim 6, wherein the second compartment is contained within the first compartment.

8. The razor according to claim 6, wherein the first compartment is contained within the second compartment.

9. The razor according to claim 6, further including an adjustment means connected to at least one of the air tube and the liquid tube for adjusting an air-to-liquid ratio ejected by the integral pumping means.

10. The razor according to claim 8, wherein the adjustment means is a mixer valve interconnected between the air tube and the liquid tube.

11. The razor according to claim 1, wherein:

the first end of the air tube includes at least two branches anchored towards opposite ends of the head assembly, and the first end of the liquid tube includes at least two pairs of branches each pair being disposed proximate a corresponding branch of the air tube.

12. The razor according to claim 1, wherein the liquid contains an antiseptic.

* * * * *